US009310135B1

(12) United States Patent
Farber et al.

(10) Patent No.: US 9,310,135 B1
(45) Date of Patent: Apr. 12, 2016

(54) CONFIGUREABLE HEAT EXCHANGER

(75) Inventors: Nathaniel Farber, Boulder, CO (US); Lee S. Smith, Boulder, CO (US)

(73) Assignee: Cool Energy, Inc., Boulder, CO (US)

( * ) Notice: Subject to any disclaimer, the term of this patent is extended or adjusted under 35 U.S.C. 154(b) by 812 days.

(21) Appl. No.: 12/790,583

(22) Filed: May 28, 2010

(51) Int. Cl.
*F28D 7/02* (2006.01)
*F28F 3/00* (2006.01)
*F28F 3/08* (2006.01)
*F28D 9/00* (2006.01)

(52) U.S. Cl.
CPC ..... *F28D 9/0037* (2013.01)

(58) Field of Classification Search
CPC ... F28D 9/0037; F28D 9/0043; F28D 9/0062; F28D 9/0006; F28F 3/083
USPC ..... 165/164, 165, 166, 167
See application file for complete search history.

(56) References Cited

U.S. PATENT DOCUMENTS 3,703,925 A * 11/1972 Ireland et al. ..... 165/151
4,377,400 A * 3/1983 Okamoto et al. ..... 96/13
4,401,155 A * 8/1983 Royal et al. ..... 165/166
4,749,032 A * 6/1988 Rosman et al. ..... 165/167
5,016,707 A * 5/1991 Nguyen ..... 165/167
5,628,363 A * 5/1997 Dewar ..... F28D 9/0062 165/164
RE36,577 E * 2/2000 Jeannot et al. ..... 62/643
6,334,985 B1 * 1/2002 Raghuram et al. ..... 422/224
6,892,802 B2 * 5/2005 Kelly et al. ..... 165/148
6,994,829 B2 * 2/2006 Whyatt et al. ..... 422/177
7,118,098 B2 * 10/2006 Thiel ..... B01D 3/20 203/71
7,272,005 B2 * 9/2007 Campbell ..... F28D 15/00 165/165
7,476,367 B2 * 1/2009 Etemad et al. ..... 422/211
8,235,093 B2 * 8/2012 Grinbergs ..... F24F 3/1411 165/165
2004/0154788 A1 * 8/2004 Symonds ..... B01J 19/249 165/166
2005/0217837 A1 * 10/2005 Kudija ..... F28D 7/0008 165/165
2006/0260790 A1 * 11/2006 Theno et al. ..... 165/166
2007/0144717 A1 * 6/2007 Zaffetti ..... F28D 9/0068 165/166

* cited by examiner

*Primary Examiner* — Frantz Jules
*Assistant Examiner* — Claire Rojohn, III
(74) *Attorney, Agent, or Firm* — Patterson & Sheridan, L.L.P.

(57) ABSTRACT

A heat exchanger is provided by assembling a plurality of individual plates having opposed faces, wherein flow channels are machined through those opposed faces, and the plates are interconnected with intervening shim plates. End plates are connected to an assembly of such plates and intermediate plates, to form a preform, which is then machined to a desired cross section. The resulting structure has a plurality of passages therethrough in one direction, and a second plurality of passages therethrough in a second direction, the passages fluidly isolated from one another. The resulting structure is configurable to a specific geometry of a flow passage, and enables heat exchange between fluids passing through the different flow channels.

19 Claims, 10 Drawing Sheets

CONFIGUREABLE HEAT EXCHANGER

BACKGROUND OF THE INVENTION

1. Field of the Invention

The present invention relates to the field of heat exchange useful for transferring heat to or from a flow able fluid. More particularly, the present invention relates to heat exchangers, and methods of manufacturing heat exchangers, where the heat exchange occurs between fluid flows physically isolated from each other. More particularly still, the invention relates to modular construction of heat exchangers.

2. Description of the Related Art

Heat exchangers are used to exchange heat between two different materials existing at different temperatures. For example, where an environment, such as a living space, is hotter than desired, air is flowed from the living space, over or through a heat exchange surface within which a cool fluid is circulated to gain heat from the flowing volume of air, thereby cooling and removing moisture from the air which is then returned to the living space. Such a heat exchanger may include, for example, a tube within which the cooled fluid flows, and fins radiating from the tube. The flowing air passes over the surfaces of the tube and fins to enable heat exchange.

Process gas flows often require the heating and or cooling thereof. Such heat exchangers may, for example, provide as simple a construct as one process conduit passing through a second conduit, and fluids passing through the conduits at different temperatures enable heat transfer from the hot fluid to the cooler fluid through the walls of the conduit(s). Additionally, shell and tube heat exchangers are available, in which conduits, through which a process fluid flows, pass through a volume through which a heat exchange medium flows, to effectuate heat exchange therebetween through the walls of the tubes.

A heat exchanger enables heat to be input into, and withdrawn from, a heat engine, such as a Stirling engine, to enable the generation of power therefrom. One style of Stirling engine operates by expanding a gas by heating on one side of the piston, while withdrawing heat from the gas at the other side of the piston, to drive the piston in a first direction. The piston may be returned using mechanical energy, such as from a crankshaft mechanism to which multiple such pistons are mechanically coupled. Gas maintained between adjacent, nearly identical pistons, such that gas is maintained between the "cold" side of one piston and the "hot" side of another. Heat exchangers must be located between each hot side volume and each cold side volume, to either provide heat to the gas or remove heat therefrom.

Traditional heat exchanger constructs require significant space and impose significant friction losses in the gas being expanded or contracted at the hot or cold sides of the pistons in comparison to the volume of the heat exchanger. In other words, the fraction or amount of heat exchange surface available in comparison to the overall volume of the heat exchanger and to the frictional losses in the gas passing through the heat exchangers is relatively low. Additionally, if readily available heat exchangers are used, the integration of them into the Stirling engine can require other changes to the integrated device, with attendant changes to the remaining design which can result in bulkier or larger heat engine constructs, suboptimal design in other areas of the system to accommodate the heat exchanger, non-optimal frictional and energy losses in the heat exchanger, or other undesirable results.

Therefore, there exists a need in the art for a compact, configurable, heat exchanger which may be used to exchange heat between a flow conduit and an external heat supply or heat sink.

SUMMARY OF THE INVENTION

There is provided a heat exchanger having a first plurality of flow conduits fluidly isolated from a second plurality of flow conduits, configured into a monolithic device and wherein the heat exchange surfaces extend substantially over the span of the device within the fluid flow paths. The heat exchanger is configurable to a specific flow path size, shape, geometry or volume and enables heat exchange into or from a fluid flowing through a conduit where the heat exchanger is placed into the path of the fluid flow. The heat exchanger may be sized to the diameter of a desired flow conduit, and the overall height or thickness of the heat exchanger helps determine the amount or quantity of heat exchange surface is present.

In one aspect, the heat exchanger is of a modular construction, having a plurality of first, generally longitudinal flow passages and second, generally transverse flow passages, each of the flow passages being fluidly isolated from the other flow passages. This construct may be provided by a plurality of individual plates, each plate providing a portion of a transverse heat exchange flow path and a portion of a longitudinal heat exchange flow path. The flow paths may be constrained into flow passages by providing channels into opposed sides of a bar shaped member, and the channels may completed into flow passages by covering the flow paths with an isolation or shim plate. Additionally, a plurality of such plates may be interconnected, with a shim plate providing isolation of the transverse flow passages of one plate with the longitudinal flow passages of a next adjacent plate, to provide a heat exchanger having multiple transverse and longitudinal flow passages. In one aspect, the shim plate also provides an attachment mechanism, wherein the shim plate may include a brazing material thereon, and the shim plate is brazed to the adjacent surfaces of the plates.

In another aspect, a plurality of such plates are interconnected, and end cap plates are provided at opposed sides of the interconnected plates, to cooperate with the adjacent plates at either side of the interconnected plates, to thereby form the final fluid passages at the opposed sides of the interconnected plates. The resulting heat exchanger may be further configured to a desired profile, such as a right circular cylinder, by turning or machining the assembly of plates, shim plates and end caps.

In another aspect, the flow passages in the plates are configured to include a plurality of fins, the fins extending generally transverse to the direction of the flow path to provide small flow passages therebetween in the direction of flow through the flow passages. These fins may be equally spaced across the flow passage, they may be generally planar and parallel to one another, and may be further configured as non planar, such as having undulations therein over the length of the flow passage. The fins increase the surface area of the flow passage in contact with the heat exchange surface of the flow passage, thus increasing the heat exchanging surface area of the heat exchanger in comparison to the volume of the heat exchanger. In one aspect, the transverse flow passage is bifurcated into two flow passages, with a rib extending therebetween over the length of the flow passage.

The transverse and longitudinal flow passages may be readily formed into plate stock material, such as by machining slots into opposed sides of such plate stock in transverse and longitudinal directions. Such machining may be accomplished by cutting, grinding, laser machining or other known mechanisms. Each plate may be interconnected to a next adjacent plate by welding, such as laser welding, by adhesives, by mechanical mechanisms such as fasteners connecting the plates together, or other affixing methodologies. Alternatively, the fins may be provided as separate accordion shaped structures which may be created by pleating a heat exchange material to form the individual ribs, which are then affixed within slots cut or otherwise formed in the plates to form the finned flow passages.

In another aspect, a heat exchanger is configured from a plurality of plates, the plates being generally of the same configuration, such that a plurality of rows of slots extend across the plate to enable one fluid to pass therethrough, and a second flow path is formed of a plurality of lands and apertures disposed intermediate of the rows of slots. The slots, lands and apertures may be stamped into the individual plates, or otherwise formed. The slots are symmetrically sized and arranged such that the orientation of individual plates may be flipped, or turned 180 degrees, such that the slots through the two plates different come into alignment. Likewise, the apertures are sized slightly larger than the lands, such that a tortuous fluid pathway is formed across the plates at a generally right angle to the thickness dimension of the heat exchanger. To enable fluid to flow through the slots, opposed end caps seal the assembly of multiple individual plates, with one end cap configured to supply an inlet and an outlet to the lands and apertures portion of the exchanger but seal the slots on opposed plates forming the termini of the stack of plates, and also include apertures for alignment with the aligned apertures providing a fluid pathway through the stack of plates.

In yet another aspect, the heat exchanger is configured of a plurality of stacked plates having a plurality of through, generally rectangular holes therethrough, and a plurality of lands and apertures disposed therebetween. Again, the plates are configured such that the generally rectangular holes are aligned to form one plurality of fluid flow passage extending through the stack of thickness direction of the heat exchanger, and the lands and apertures form a second fluid path for heat exchange. A pleated, accordion shaped fin structure is located through each of the plurality of aligned holes.

In another aspect, the heat exchanger is useful for heat exchange in a Stirling engine, wherein the heat exchanger is located in a flow path between pistons in the engine. In this configuration, the gas used within the Stirling engine passes through the longitudinal flow passages, and a heat transfer fluid, typically a liquid, is flowed through the transverse flow passages. One stream of heat exchange fluid provides heat to the hot side of the engine, and a separate stream of fluid cools the gas used in the Stirling engine at the cold side of the Stirling engine, each stream passing through a separate heat exchanger. A heat exchange unit, incorporating two such heat exchangers, may be provided to support the individual heat exchangers in the fluid flow paths to enable heat exchange. Where the transverse flow passages are segmented or bifurcated into two separate passages, the heat transfer fluid may be flowed in opposite directions through adjacent passages of the bifurcated passages, to enable a relatively uniform heat transfer between the fluid and, the gas over the transverse direction of the heat exchanger.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
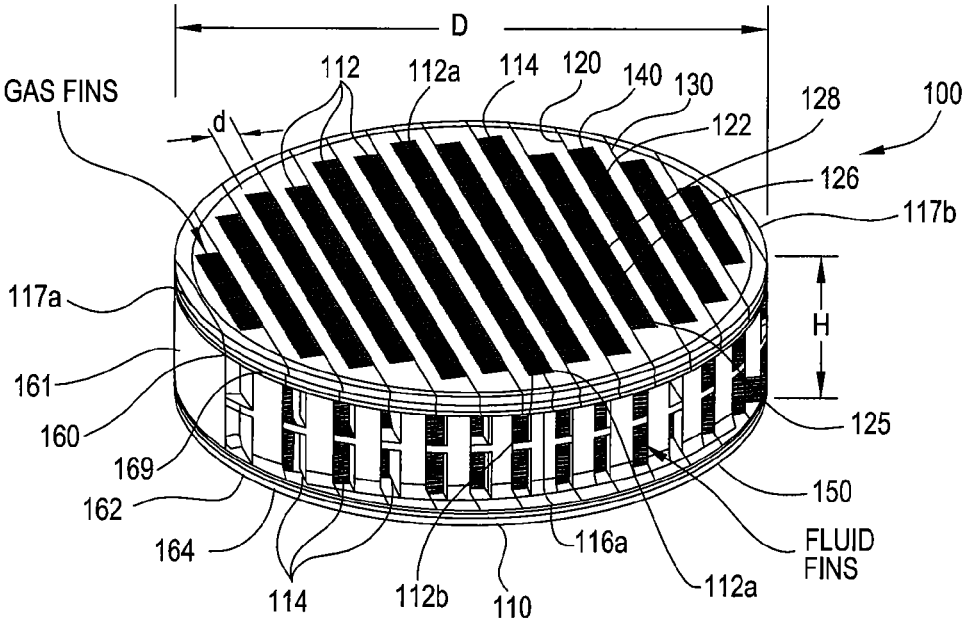
FIG. 1 is a perspective view of a heat exchange element.

Referring initially to FIG. 1, there is shown a perspective view of a heat exchanger 100, having a generally right cylindrical shape having a low aspect ratio, i.e., H/D is substantially less than one. Heat exchange element 100 includes a plurality of longitudinal flow passages 112, and a plurality of transverse flow passages 114, formed by the interaction of the geometries of plates 110 in which they are formed and intermediate shim plates 116 (best shown in FIG. 3) located and affixed between each plate 110. Cap plates 117*a*, 117 *b* located at either end of an assembly or stack of plates 110 and shim plates 116 complete the body of the heat exchanger 100. Preferably, a shim plate 116 is located and affixed between each of cap plates 117*a*, 117*b* and the adjacent plate 110, or a thin sheet of braze material may be located here.

Figure 2:
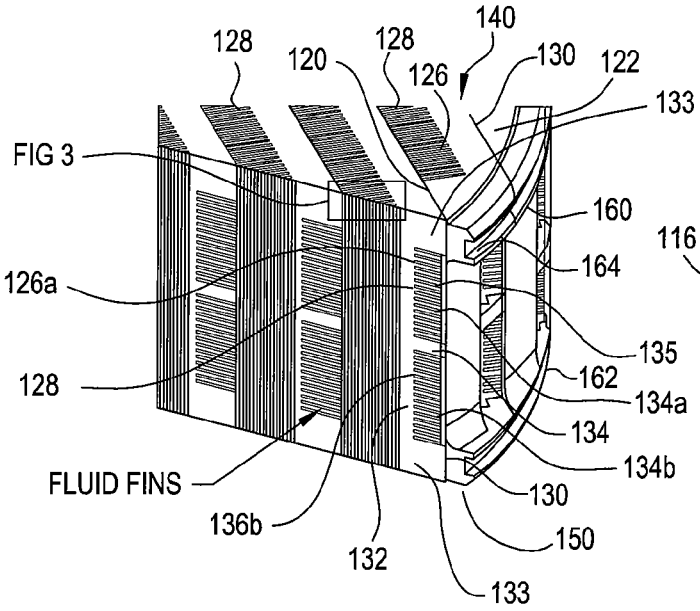
FIG. 2 is a partial perspective sectional view, of the heat exchange element of FIG. 1.

Referring now to FIGS. 1 and 2, each of plates 110 include a first transverse 120 portion, a second, opposed transverse portion 130, and opposed upper and lower surfaces 140, 150. To form a portion of longitudinal flow passages 112, each plate 110 includes along first transverse portion 120 a recess 122 extending therein, extending across first transverse portion 120 from upper surface 140 to lower surface 150. Recess 122 includes sidewalls 124, 125 and base 126, (FIG. 1) and a plurality of fins 128 extend from base 126 substantially parallel to the side walls 124, 125. Gaps 129 (best shown in FIG. 3) for fluid flow extend between adjacent fins 128, and between each fin 128 and end faces 124, 125.

Referring still to FIGS. 1 and 2, to form a portion of transverse flow passages 114 each plate 110 also includes a plurality, in this embodiment two, transverse recesses 131*a*, 131*b* projecting into second transverse portion 130 and extending across the entire transverse span of the second portion 130. As best shown in FIG. 2, wherein heat exchanger 100 is shown in section, these recesses 131*a*, 131*b* extend to a depth into second portion 130 such that a web 132 of material remains at the base of the recess 131*a*, 131*b*, the opposed side of the web 132 forming the base 126 of recess 122 in first portion 120. Recesses 131*a*, 131*b* are separated by a spacer 134, and bounded by opposed lands 133, such that two channel shaped recesses 131*a*, 131*b* are formed. Within each recess are disposed a plurality of transverse fins 135, these transverse fins 135 disposed generally perpendicular to fins 128 and extending across the width of the heat exchanger 100 to enable fluid flow therebetween.

Figure 3:
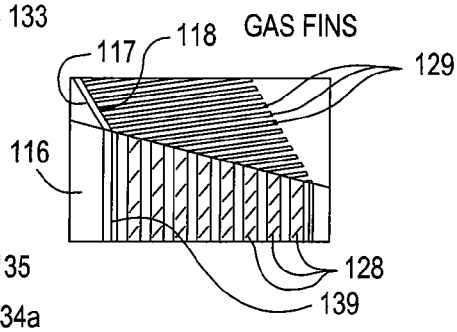
FIG. 3 is a magnified view of a portion of the heat exchange element shown in FIG. 2.

Referring now to FIGS. 1 and 3, to form completed flow passages 112, 114, a plurality of plates are stacked together, with a shim plate 116 having opposed first and second faces 117, 118 disposed between each adjacent pair of plates 110. Longitudinal flow passage 112 is formed by the cooperation of recess 122 and the first face 117 of shim plate 116, and transverse flow passages 114 are formed by the cooperation of recesses 131*a*, 131*b* with the second face 118 of shim plate 116. Fins 128 extend from base 126 of recess 122 to contact, or nearly contact, the first face 117 of shim plate 116, thereby forming individual passages 129 between each fin 128 and the space between fin 128 and sidewalls 124, 125. Likewise, each transverse flow passage 114 is formed by the cooperation of recesses 131*a*, 131*b* and the second surface 118 of shim 116, and transverse fins 135 extend from web 132 to contact, or nearly contact, second surface 118 of shim 116 to thereby form individual flow passages.

As also shown in FIG. 1, the heat exchanger may be configured from two, mirror image, halves, such that two of the plates 110, in particular plates 110*a* and 110*b*, are disposed on one end of each mirror image subassembly, and abutted to a central shim plate 116*a*, to form a complete heat exchanger. With these two plates, the recesses 122 of each plate face each other, such that two central longitudinal flow passage 112*a, b* are formed. To enable a uniform depth or width d of each longitudinal flow passage, the depth of recesses 122 in each of plates 112*a*, 112*b* is one-half the depth of the recesses 122 of the remaining plates, so that the sum of the depths of the two central longitudinal flow passages sums to the dimension d. As is also shown in FIG. 1, the longitudinal recesses 122 of each plate 110 face and abut the central shim plate 116*a*. Finally, cap plates 117*a, b* disposed at either end of the interconnected group of plates 110 through a shim plate 116.

Heat exchange element 100 is configured, as shown in FIG. 1, as a component that may be located in-line in a heat exchange unit 180 (FIG. 8), such that fluid in the conduit (FIG. 8) passes through the longitudinal flow paths 112, and fluid in a second conduit 182 flows through the transverse flow paths 114 to form a heat exchanger. To provide sealing of the heat exchange element 100 to housing 310 of heat exchange unit, (FIG. 8), a first and second radial boss 160, 162 extends from the outer circumference of the heat exchange element 100 to form a circumferential recess 161 therebetween, and each boss 160, 162 includes a groove 164 extending radially therein into which a seal, such as an o-ring (not shown) may be located. The heat exchanger 100 is assembled into the opposed ends of the housing 310, as will be described further herein, such that the seals seal between the grooves in the boss and the internal diameter of the housing.

Figure 4:
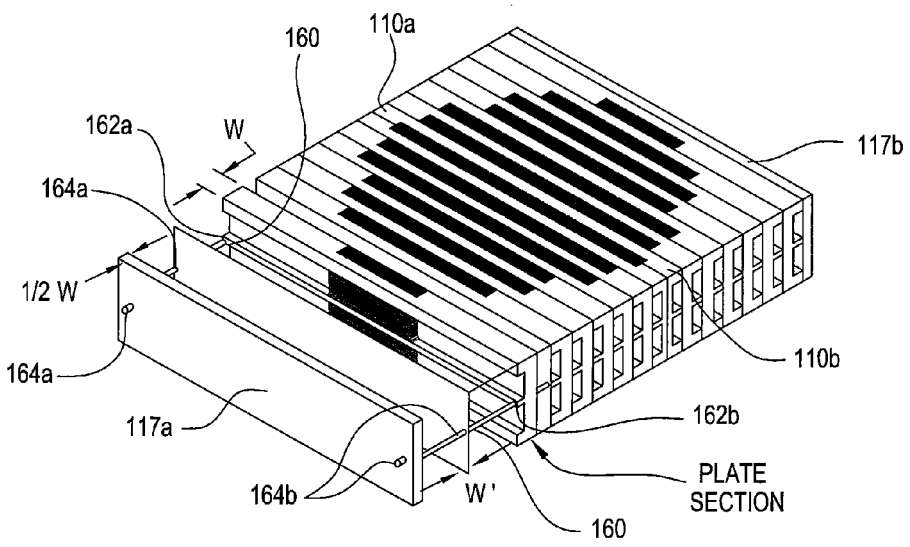
FIG. 4 is a perspective view of a preform of the heat exchange element shown in a partially assembled state.

Referring now to FIG. 4, an assembly methodology for assembly of the shims 116, cap plates 117*a*, 117*b* and individual plates are shown. In this assembly, each shim plate 116, end cap 117*a, b* and plate 110 has the same length l and height h. Additionally each cap plate 117*a, b* has sufficient width such that, when the final assembly of the plates and shims if finished, the assembly may be cut into a circular disk, each of plates 110 have the same width w, and each shim has the same width w'. In the construct shown, the shim plate 116 width is significantly less than that of plates 110, as the shim plates 116 only need provide the boundary of the flow passages 112, 114, and, as described further herein, the attachment methodology to hold the shims 116, plates 110 and cap plates 117*a,b* together. Thus, they should be as thin as possible, to reduce the amount of space they take up in the finished heat exchanger 100, and enable rapid heat transfer therethrough, while being thick enough to limit their bending and stress from different pressures exerted on the opposite sides thereof.

In one embodiment, the heat exchange element 100 is formed by locating the shim plates 116 and the plates 110 over alignment rods 160, such as by forming opposed holes 162*a*, 162*b* in the plates 110 and corresponding holes 164*a*, 164*b* in shim plates 116 and in the end caps 117*a*, 117*b*. The holes 162, 164 are located outside of the active, or finned area, of the heat exchanger, and are provided to align the various plates during assembly. The heat exchanger 100 is, in this embodiment, constructed in two mirror halves, such that the center plates 110*a*, 110*b*, having the greatest span of the channel therein, form one end of one mirror half, and an end plate 117*a* or 117*b* forms the other end of a stack. Each mirror half is assembled by locating an end cap, for example end cap 117*a*, over rods 160, and then next locating a shim 116 thereover, followed by a plate 110, with the transverse flow passages 114 of the plate 110 facing the shim 116 and end cap 117*a*. This procedure is repeated, by locating another plate 110, another shim 116, etc., over the rods until one of the two central plates, in this case plate 110*a*, is located over rods 160 and brazed to the adjacent shim 116. When both mirror halves are formed, the adjacent faces of the two plates having the shallower fins therein are abutted to a common shim plate 116*a*. This assembly is then squeezed together in a jig or fixture (not shown), and loaded into a vacuum furnace and heated to 1090 to 1120 F causing the shim plates to braze together the plates 110 and cap plates 117*a, b*. resulting in a generally rectangular structure. By employing vacuum brazing, a flux is not required. Additionally, non-vacuum brazing employing a flux, or dip brazing, where the assembly is dipped into a liquid salt and the salt acts as a flux, may also be employed. It should be noted that the plates 110 being assembled together from the cap plate 117*a* or 117*b* to the center plate 110*a* are not identical, in that the span of the channels therein is increased, in a generally stepwise fashion, from the plate adjacent to the cap plate 117*a* to the center plate 110*a*. Alternatively, the heat exchanger may be assembled without first creating two mirror halves, by simply assembling a sequence of plates 110 and shims 116 and capping with appropriate cap plate 117*a* or 117*b*, and then following the above described procedure to braze them together. The resulting rectangular preform 170 is then machined, such as by being turned in a lathe or machined using a mill or ground to yield the generally right circular heat exchange element 100 structure of FIG. 1.

To enable brazing together of the heat exchange elements, shim plate 116 preferably includes a brazing material inherently formed thereon, or physically comprising the shim 116. For example, shim 116 may be formed of a #8 clad material, having a 3003 aluminum alloy core and a 4004 aluminum alloy other material, such that the 4004 material will melt at a lower temperature than the 6061 material of the plates or the 3003 core of the shim plates, enabling brazing of the shim plates 116 to the plates 110 and cap plates 117*a, b*. Other alloys, brazing materials and shim plate materials may also be used.

Figure 5:
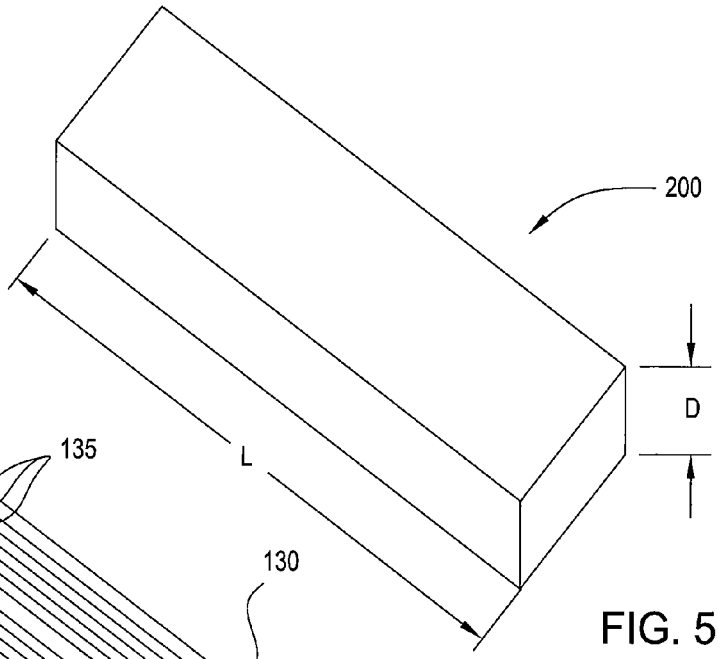
FIG. 5 is a perspective view of a section of bar stock used to form the plates used in the assembly of a heat exchange element of FIG. 1.
Figure 6:
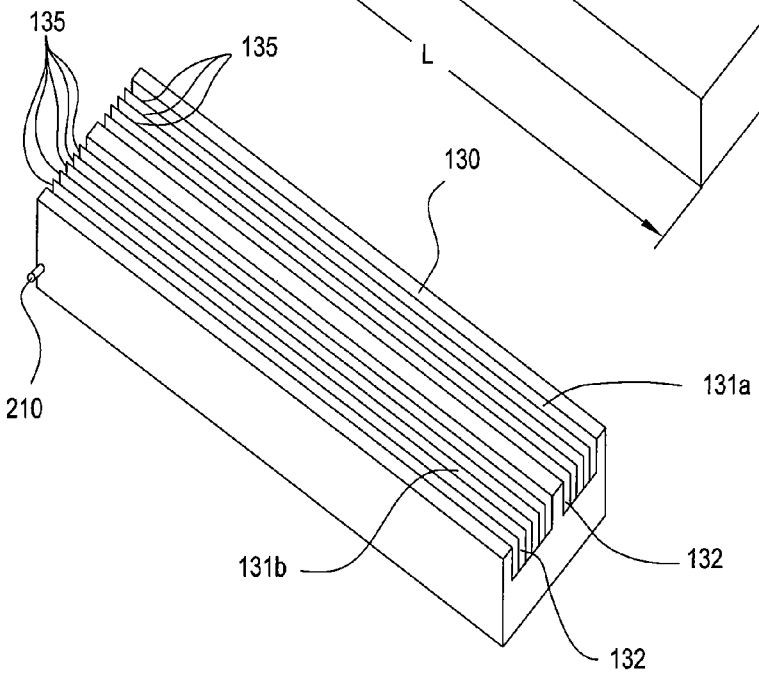
FIG. 6 is a perspective view of the bar stock of FIG. 5, having a transverse flow passage including fins machined in one side thereof.
Figure 7:
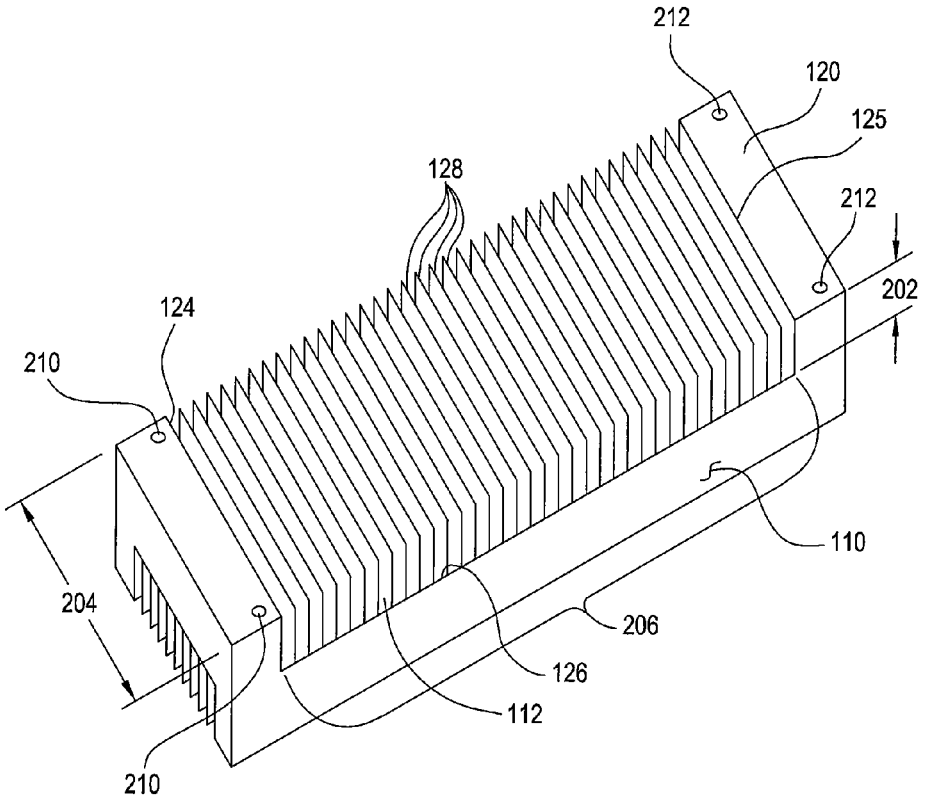
FIG. 7 is a perspective view of the bar stock of FIG. 7, having a longitudinal flow path extending through a face thereof opposed to the transverse flow passages.

Referring now to FIGS. 5 to 7, the manufacturing sequence for the plates 110 (FIG. 1) is shown. Starting in FIG. 5, a piece of bar stock 200, having a generally rectangular profile of a length l, a width w, and a height h, wherein the height h is approximately or preferably the finished width W (FIG. 1) of the heat exchange element 100, and the length of the bar stock 200 is slightly larger than the diameter D (FIG. 1) of the heat exchange element 100 is provided. The width of the bar stock 200 is chosen, as will be described further herein, to ensure that a support and heat exchange web extends between the bases of the opposed fins which will be located within the finished plate 110. In one embodiment, bar stock is 6061 aluminum, although other base materials may be used. Referring now to FIG. 6, the formation of the fins for the transverse flow passage 114 is provided on the second transverse face 130 of bar stock 200. In this embodiment, the transverse flow passage 114 is bifurcated into two sub-passages 131*a*, 131*b* separated by a web 132. Each portion of the transverse flow passages 131*a, b* is provided by cutting away bar stock material to leave behind fins 135. The fins are cut to a depth into the bar stock 200 such that their remains a web 132 of bar stock material between the bases of the fins 135 to either side thereof. At the priphely of the heat exchanger, The transverse flow channel (cross slots) are reduced in size so that the average gas temperature associated with any bar, where the average is taken over only those gas channels associated with the oil channels of that particular bar, is equal to that of all other bars.

Referring now to FIG. 7, the bar stock is shown having had a second plurality of fins, in this case, fins 128 are created by cutting into transverse face 120 of the bar stock 200, to a depth 202. The fins 128 are cut across a width 204 of the bar stock, and the collection of individual resulting fins cover span 206 of the plate, such span varying based upon the ultimate position of the plate 110 in the finished heat exchanger. The span defines the location of the sidewalls 124, 125, and the depth of the fins defines the base 126 of the recess from which the fins project. In this embodiment, the fins extend perpendicular to the base 126 and parallel to each other and to the side walls 124, 125, but other geometric configurations may be provided. The cutting of the fins forms three sides of the longitudinal flow passage 112, which is completed by the placement and attachment of a shim 116 (FIG. 1) thereagainst. All of the fins 128 have the same fin height or depth 202, except those in the center plates are approximately ½ of that height. Thereafter, holes 210, 212 are drilled across the width of the bar stock 200 adjacent to the ends thereof. The rods need no extend through the end plates, and thus the end plates need not be drilled through. As previously described, the plates 110 are brazed to shims 116 and cap plates 117*a, b* to form a preform for heat exchange element 100, which is then turned or otherwise machined into the configuration of the heat exchange element 100 of Figure The depth of the channels 135, as shown in FIG. 6, (depth is the dimension parallel to "D" in FIG. 5), is less in plate sections that have a lesser quantity of fins 128 on either side of the channels 135. This is because channels 132 require less flow rate through them and less surface area in areas of the heat exchanger where there are less fins 128 that must be heated or cooled, to maintain an even temperature in all fins 128 throughout the heat exchanger.7.

Figure 8:
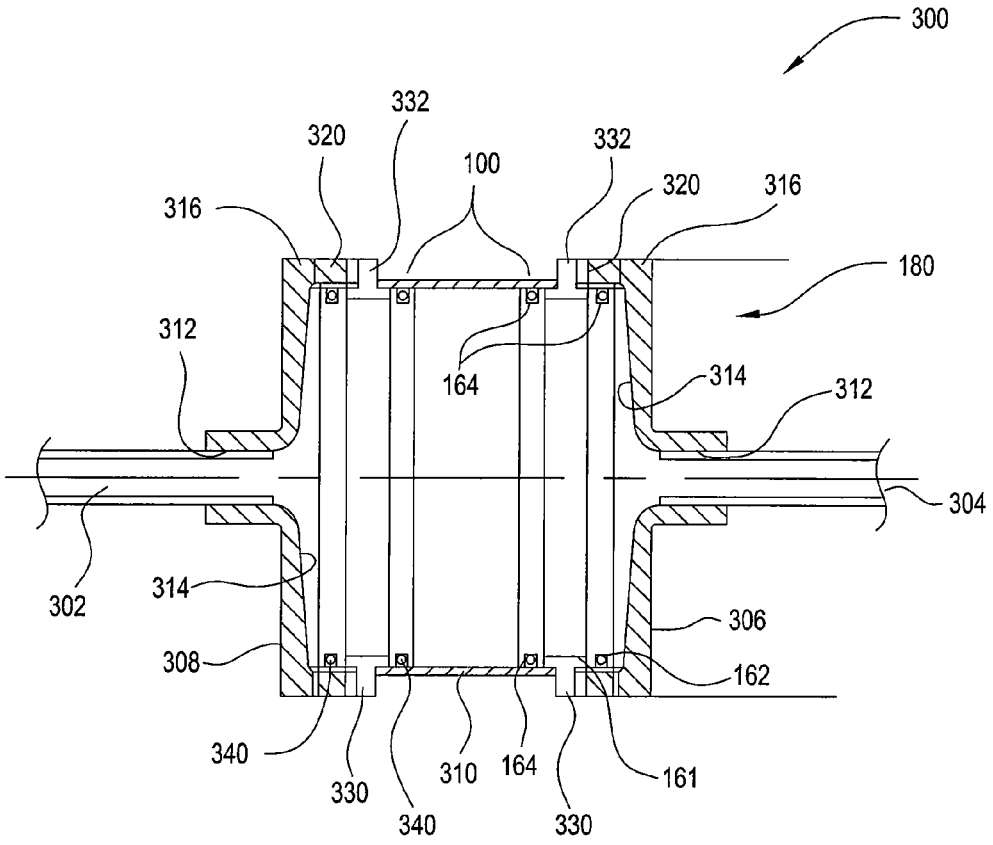
FIG. 8 is a sectional view of the positioning to two heat exchangers of FIG. 1 into a heat exchange unit.

Referring now to FIG. 8, the heat exchange element 100 of FIG. 1 is shown located in a heat exchange position in a heat exchange unit 180 within a fluid circuit of a Stirling engine (not shown) It this configuration, a housing 300 is linked, via suitable piping, 302, 304, to the hot side (piping 302) and the cold side of a Stirling engine (not shown), (piping 304). Housing 300 positions two individual heat exchangers, such as those shown and described with respect to FIGS. 1 to 7 hereof, Housing 300 includes opposed flanges 306, 308, and a generally cylindrical support and connection housing 310 together forming the internal boundaries of the housing. Flanges 306, 310, include a central coupling 312 to receive the ends of conduits 302, 304 therein, and a generally tapered or cone shaped inner face 314 terminating with an attachment flange 316. This shape enables the distribution of the gas along the entire face of the heat exchangers where through fins are present. Flanges 316 connect to the connection housing 310, through connection flanges 320.

Fluid from the Stirling engine cycles through the individual heat exchangers by first passing through the pipings 302 and 304, and thence through the fins (See FIGS. 1 and 2) of the heat exchangers. To supply heat exchange fluid, connection housing 310 also include pairs of a heat exchange fluid inlet 330 and a heat exchange fluid outlet 332. One outlet 332 and one inlet 330 service each heat exchanger 100, and the opposed bosses 162, 164 of each heat exchanger are positioned to either side of the inlet 330 and outlet 332, such that a seal ring 340 positioned in each of the seal ring grooves 164 of the heat exchangers contacts the interior of the connection housing to form a fluid tight seal therewith. As a result, fluid entering inlet 330 flows into the cavity formed by the circumferential recess 161 of the heat exchangers and the adjacent inner wall of the connection housing 310, enabling the fluid to be distributed to all gaps (FIG. 3) in heat exchanger. Blocking fins or bosses (not shown) may be positioned within connection housing 310 at 180 degrees apart along the inner surface thereof, 180 degrees out of phase with the position of the inlet 330 and outlet 332, to block flow leakage between the inlet 330 and outlets 332 along the recess 161 in the heat exchanger 100.

Referring now to FIGS. 9 to 12, there is shown an additional embodiment of a heat exchanger manufactured from a series of plate shaped members stacked together to form crossing flow paths for heat exchange therebetween.

Figure 9:
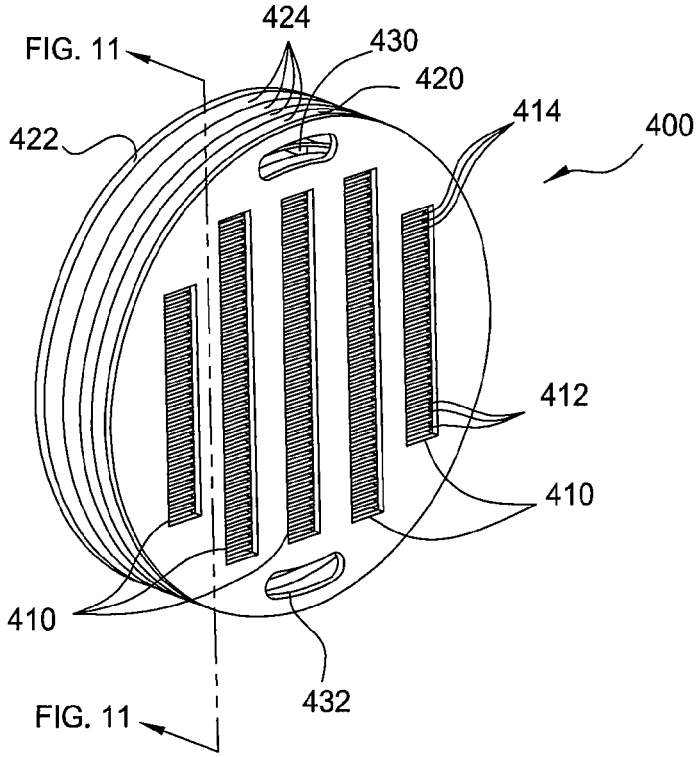
FIG. 9 is a perspective view of an additional construct of a heat exchanger wherein individual plates having heat exchange pathways therein are stacked in a thickness direction of the heat exchanger to form the final heat exchanging structure.

Referring first to FIG. 9, heat exchanger 400 is shown in perspective, and generally includes a plurality of, generally rectangular openings which extend generally parallel to one another, and include a plurality of slits 412 extending between fins 414 therein. The slits 412 extend fully through the thickness direction of the heat exchanger 400. As shown in the figure, the heat exchanger is configured from a plurality of generally round plates 424 (although other shapes are possible depending upon individual application needs), which are stacked together and connected at opposed sides thereof to end plates 420 and 422. End plate 422 is preferably a solid right cylindrical element having ribs and slots therethrough (not shown). End plate 420 includes two apertures therein, forming an inlet 430 and an outlet 432 for the second heat exchange fluid.

Figure 10:
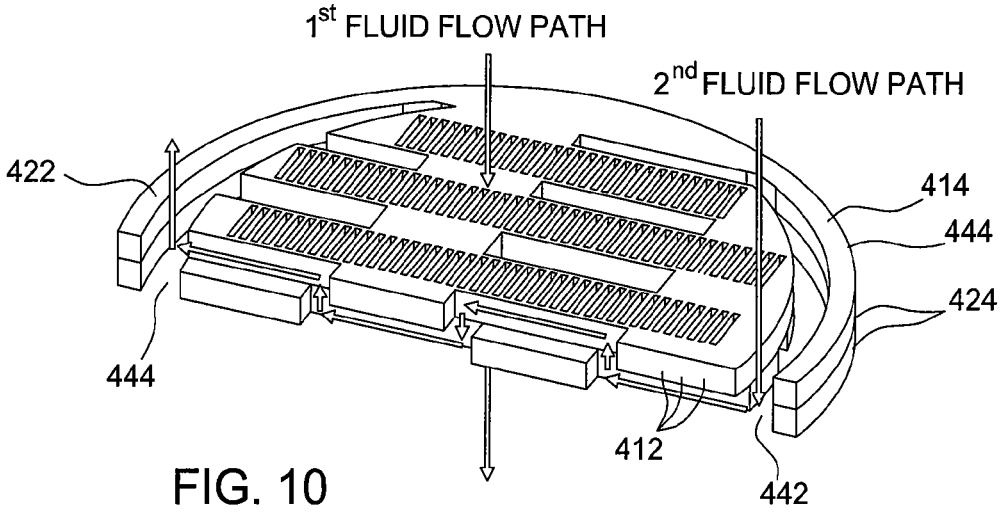
FIG. 10 is a partial, sectional view of the heat exchanger of FIG. 9 showing the individual fluid pathways therethrough.
Figure 11:
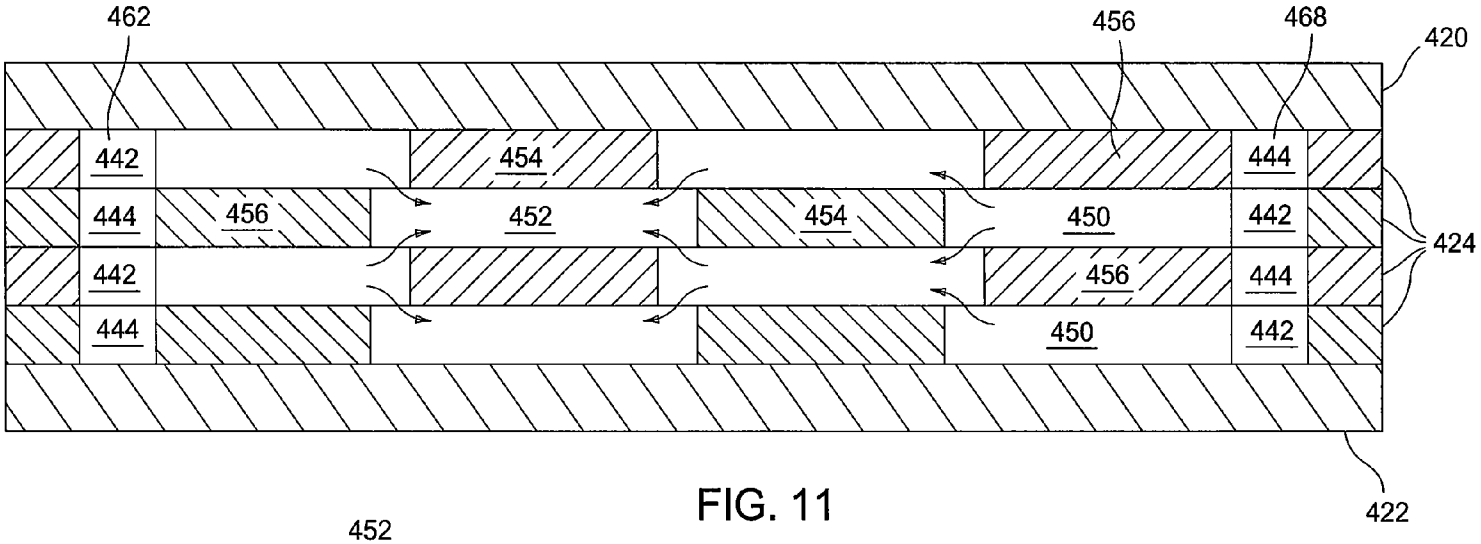
FIG. 11 is a sectional view of FIG. 9 at 11-11, showing the individual cross flowing pathways therethrough.
Figure 12:
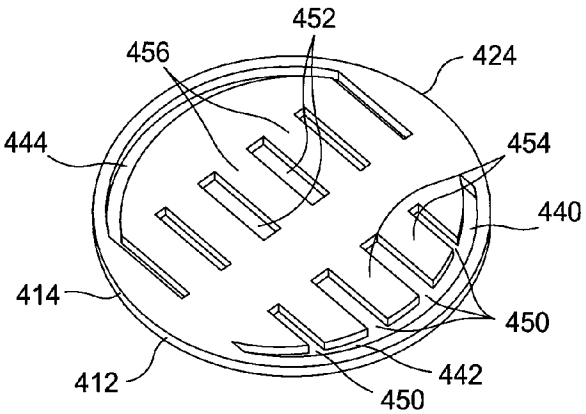
FIG. 12 is a perspective view of an individual plate used to construct the heat exchanger of FIGS. 9 to 11.

Referring now to FIGS. 10 to 12, the configuration of the plates 424 which are stacked together to form the body of the heat exchanger 400 are shown. Each plate 424 includes a plurality of slots 412 formed therethrough, between individual ribs 414. The slots on each plate 420 are, upon assembly of the plates 424 as shown in FIG. 10, aligned to enable fluid flow the in the direction of the thickness dimension of the heat exchanger 400.

Referring now particularly to FIGS. 10 and 11, to enable fluid flow laterally through the heat exchanger, each plate 424 includes a pair of opposed, generally actuate in shape, manifold recesses 442, 444, that are in separate fluid communication with inlet 430 and outlet 432 (FIG. 9). As best shown in FIG. 12, for each of plates 424, a plurality of first apertures 450 extend, generally parallel to one another and between the rows of slots 412 and fins 414 and fluidly isolated there from. A second aperture 452 is formed, generally collinearly with first slot 450, such that a solid land 454 extends between the first and second apertures 450, 452. This second aperture 452 is not in direct contact with second manifold region 442, such that a solid land 456 extends from the second aperture 452 to the second manifold 444.

To form the body of heat exchanger 400, plates 424, are stacked one on the other, but the orientation of each successive plate is reversed, either by flipping them over, or rotating them 180 degrees with respect to each other. The resulting structure is best understood with reference to FIGS. 10 and 12.

As the individual plates 424 are reversed with respect to each of the plates 424 in a stack of plates, and inlet manifold 460 formed as a plurality of first and second manifold regions 442, 442 is formed, and an outlet manifold 462 is likewise formed from fluidly connected alternately stacked manifold regions 442, 444 of the plates 424 (FIG. 11). As the apertures 450, 452 are slightly longer than the land 454, 456, and the alternating plates 425 are flipped or rotated with respect to one another, a tortuous path, as shown in FIGS. 10 and 11, is formed between the manifolds 460, 462.

Stamping is preferably used to form the various openings in the plates 424, 420 and 422. Alternatively, etching, laser cutting or machining is contemplated. Additionally, where stamping is used, the individual plates 424 need to be relatively thin so that fine features, particularly the slots and fins 412, 414 can be properly forms. Thus, it is contemplated that the individual plates 424 with have a thickness on the order of 0.10 to 0.040 inches. As a result, the heat exchanger formed will have a large enough number of plates 424, well in excess of the 4 shown in FIG. 11.

Figure 13:
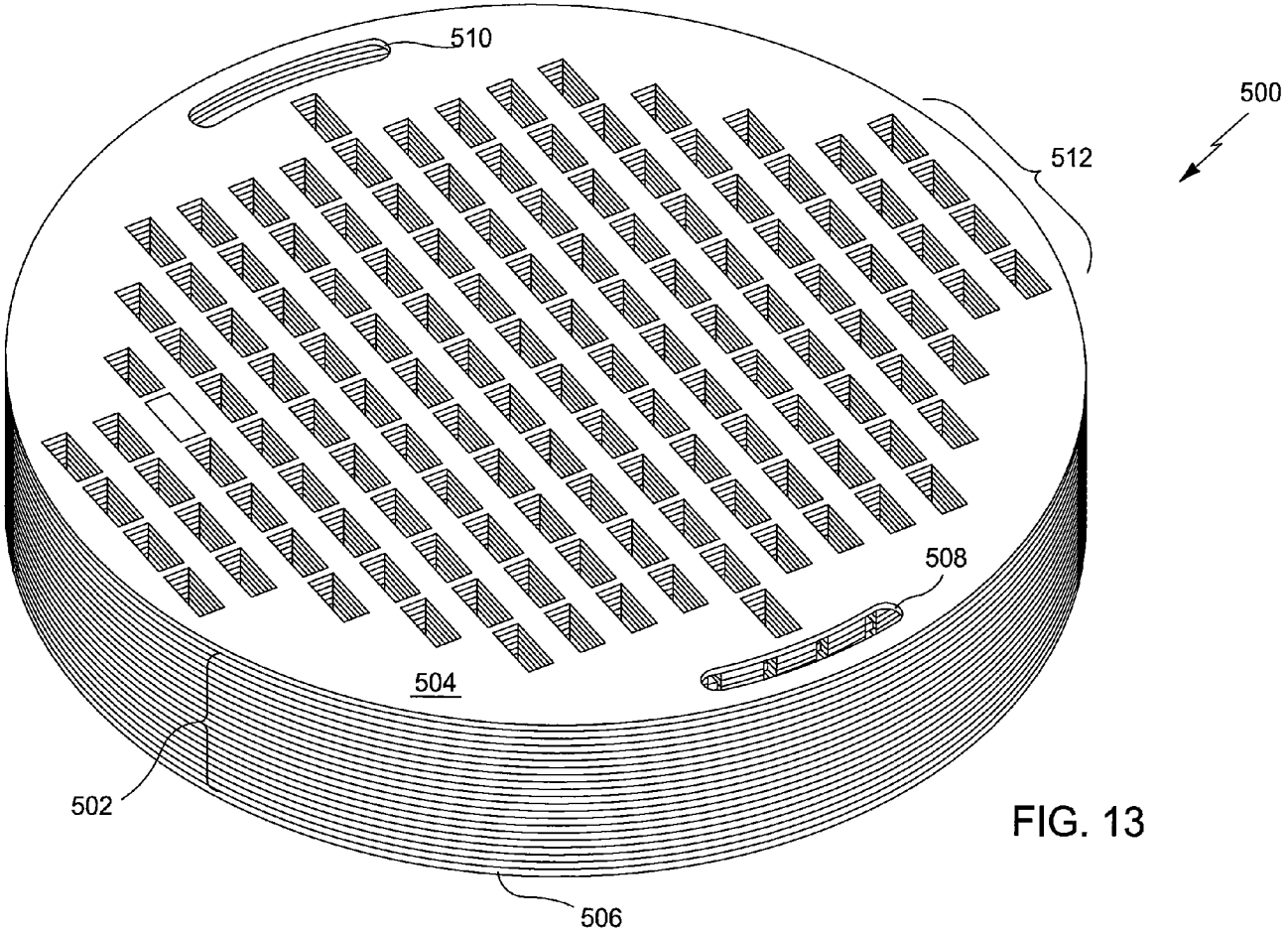
FIG. 13 is a perspective view showing an additional embodiment of the heat exchanger, wherein pleated plates to provide fins are used as part of the heat exchange surface.

Referring now to FIG. 13, there is shown an additional embodiment of a heat exchanger, wherein the fins and slots of the prior described heat exchanger are replaced by apertures extending fully through the heat exchange structure, in which material having an accordion or pleated shape is located. As also with the previously described heat exchanger shown in FIG. 9, the cross flow passages have spaced lands and apertures, as will be further described herein.

As shown in FIG. 13, heat exchanger 500 has a generally right circular shape and is formed of a plurality of individual inner plates 502, a first end plate 504 and a second end plate 504 located to either side of a stack of the inner plates 502. First end plate 506 further includes and inlet 508 and an outlet 510, extending therethrough and diametrically opposed to one another, as well as a plurality on individual generally rectangular and symmetrically distributed through passages 512 extending therethrough, as will be described further with respect to FIG. 14. Second plate 506 likewise includes through passages 512 (not shown), but does not include an inlet or outlet.

Figure 14:
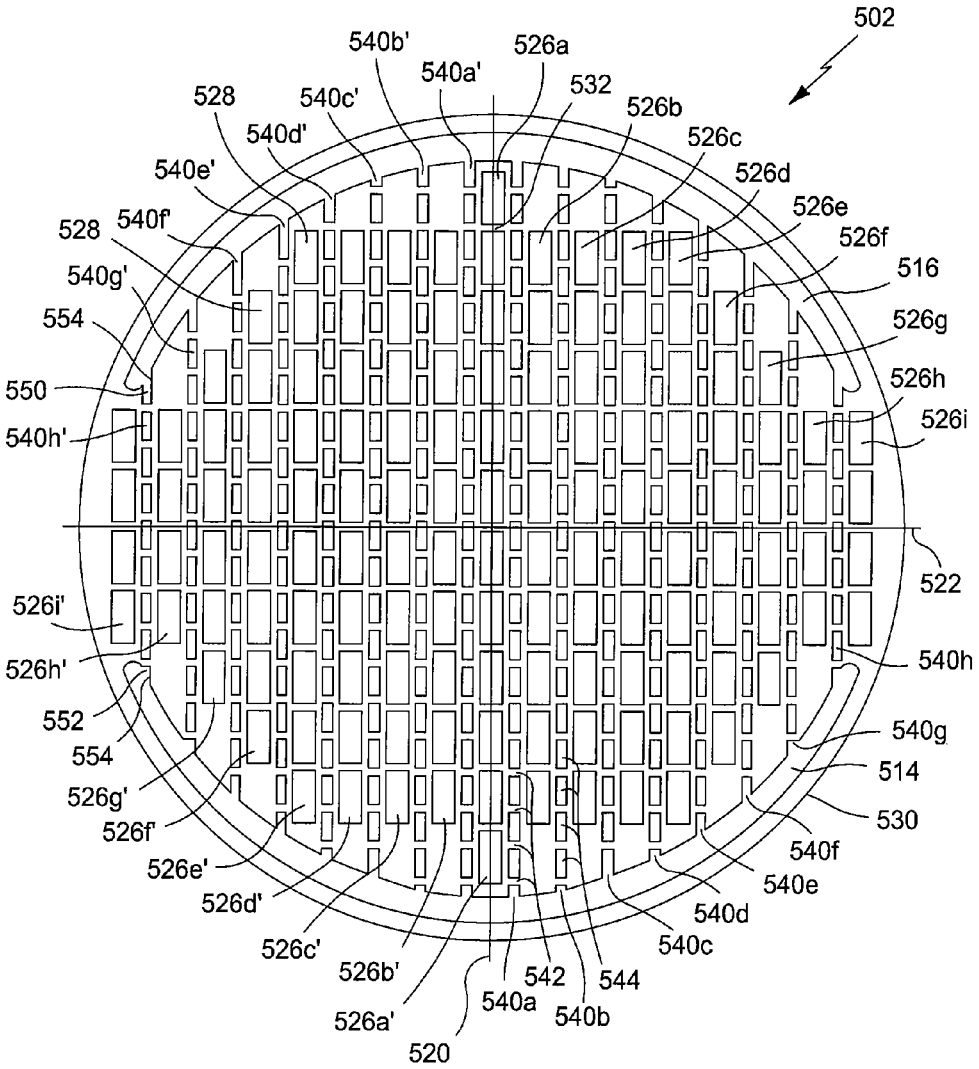
FIG. 14 is a plan view of an individual plate used in the heat exchanger of FIG. 13.

Referring now to FIG. 14, an individual plate 502 of the heat exchanger 500 is shown in plan view. Plate 502 is of generally circular shape, having diametrically opposed first and second manifold cutouts 514, 516 of a generally arcuate shape following the contour of, but spaced from, the outer circumference 530 of the plate 502. Each of manifold cutouts extends 120 to 130 degrees in such an arc, centered upon first axis of symmetry 522. Extending across the plate 502 are a series of generally parallel rows 526 (generally) of spaced fin receiving apertures 528. Row 528 a is disposed generally centered over, and collinear with, a first axis of symmetry 520, and rows 526*b-l* extend generally parallel thereto and generally equally spaced from one another in a first direction from the axis of symmetry 520, and rows 526*b'-i"* extend generally parallel thereto and generally equally spaced from one another in a second opposed direction from the axis of symmetry 520. The number of individual fin receiving apertures in each of rows 526 is dependant on three factors: The length, in the direction of axis of symmetry 520, of each aperture 528, the spacing between each fin receiving apertures 528 which is formed of a web 532 of plate material, and the span of the plate 502 at each row 526 location. Thus, the fin receiving row 526*a*, along axis of symmetry, has the greatest available span across the plate 502, and thus the greatest number, in this case 12, fin receiving apertures 528 are located therein, whereas rows 526*i* and 526*i'*, located furthest from the first axis of symmetry 520, have the smallest number of fin receiving apertures 528, in this case four. Additionally, the fin receiving apertures 528 of any row are disposed to have an equal number on either side of second axis of symmetry 522, such that in rows 526*i* and 526*i'*, there are two to either side thereof, and in row 526*a*, there are six to either side thereof.

Referring still to FIG. 14, a plurality of cross flow land and slot rows 540 *a-h* and *a'-h'* are located across the span of the plate 502, such that each of the rows 540 is located between, and generally parallel to, a pair of fin receiving rows 526, Each cross flow slot and land row 540 include a plurality of slots 544 thereon, each slot having substantially equal dimension and being substantially equally spaced from any other slot 544 in any slot and land row 540, such that each slot is separated by a land 542, likewise of substantially equal dimension from one to another. However, the span of each land 542 in the direction parallel to the axis of symmetry 520 is far shorter than the span of each slot 544 in that same direction. At the opposed ends (for ease of understanding, only ends 552 and 550 of land and slot row 540*h* are described), each of the land and slot rows 540 having a similar feature), the row 540 includes a partial slot 544 extending into communication with one of manifold cutout 514, 516. For partial slots 544 in row 540*h'*, one such partial slot 544 is merely a notch cutout in the plate 502, whereas partial slot 544 in communication manifold 516 extends in slot form therefrom. The span of each partial slot may vary between such a notch type cutout to that extending a distance from a manifold cutout 514, 516 greater than that of the otherwise substantially identical slots 544. As each of the slot and land rows 540*a-h* and *a'-h'* are disposed essentially mid span between any adjacent group of fin receiving slots 526, they are equally spaced from one another and land and slot rows 540*a-h* are disposed to a first side of axis of symmetry 520, and land and slot rows 540*a'-h'* are disposed to the other side of axis of symmetry 520. Each co-pair of slots, e.g. 540*a-a'*, 540 *h-h'*, are equally spaced from the axis of symmetry to either side thereof. Thus, along and extending from axis of symmetry 520 all of land and slot rows 540 are symmetrically disposed. However, unlike apertures 528, the slots 544 are not located symmetrically about axis of symmetry 522, but are offset therefrom. For example, in the embodiment shown in FIG. 14, over ten full slots extend from axis of symmetry 522 in a first direction (downward on the page) whereas slightly more than nine full slots extend in the other direction from axis of symmetry 522. The symmetries and asymmetries of the slots 544 and apertures 528 enable a plurality of plates 502 to be stacked one atop the other to create the passages 512 (FIG. 13) into which individual fin plates (FIG. 15) will be located, as well as a series of tortuous paths, such as those shown in FIGS. 10 and 11 in the previously described embodiment, extending across the span of a heat exchanger 500 (FIG. 13). Because the individual lands 542 and slots 544 are offset from the axis of symmetry 542, but the apertures 528 are not, and the land 542 and slot 544 size are chosen so that the land 542 span is smaller than the slot 544 span, and they are offset from the second axis of symmetry 522, rotating intervening plates, or flipping adjacent plates 502 into a stack over with respect to one another will result in alignment of the apertures 528 of each fin receiving aperture row 526 located on one side of axis of symmetry 522 to align with, and overlay, the apertures 528 of that same fin receiving aperture row 526 on the other side of the axis of symmetry 522. However, as the number of slots 544 and lands 542 in each of slot and lands rows 540 is different on either side of axis of symmetry 522 but a slot 544 in each such row 540 partially overlies the axis of symmetry 522, but the rows 540 are parallel to axis of symmetry 520, the rotation of alternating plates by 180 degrees, or flipping of the plates 502 to achieve the same effect, will result in non-alignment of a slot 544 on one side of the axis of symmetry 522 with a slot 544 in the other of plates 502. However, as discussed previously, the slots 544 and lands 542 in each land and slot row 540 are sized such that a land 542 to one side of a row 540 of a first plate overly a slot 544 of a second plate to form the tortuous pathway across the heat exchange structure in the same manner as described with respect to FIGS. 10 and 11 herein, except a far larger number of apertures and lands are provided across any span of the heat exchanger 500. Likewise, the slots 544 and apertures 528 formed in plate 502 are preferably stamped.

Figure 15:
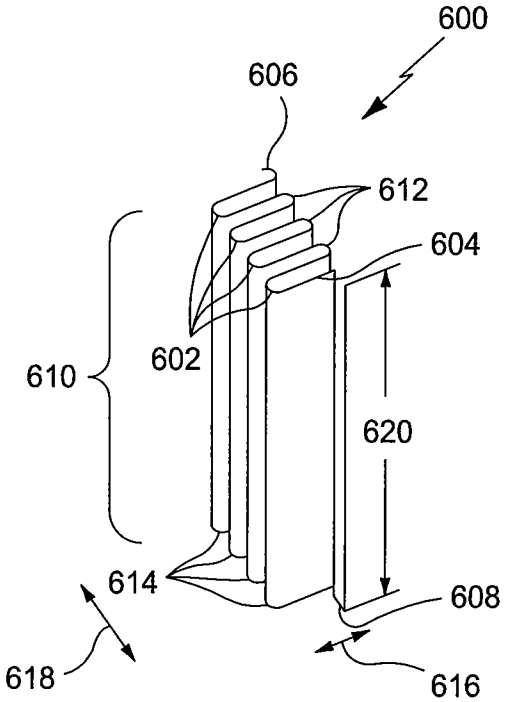
FIG. 15 is a perspective view of an individual pleated plate used to provide fins useful in the heat exchanger of FIG. 13.

Referring now to FIG. 15, there is shown a pleated fin plate 600 configured to be received in the through passages 512 of heat exchanger 500 (FIG. 13). Pleated fin plate 600 is generally configured by folding a strip of metal over itself, and then back over itself, a plurality of times to form a plurality of pleats 602, such that each pleat forms two adjacent, spaced fins 604. The ends of the strip are likewise bent back, to form rounded ends 606, 608. These rounded ends are located in the same plane as the plurality of pleat rounded ends 612. At the other side of pleat rounded end 612 are second pleat rounded ends 614. The entire pleat has a pleat width 616 which is slightly larger than the width of a through passage 512, a span 618 which is slightly larger than the height of a passage 512, and a height 620 that is approximately equal to the depth of a passage 512. As each passage 512 is substantially identical, each pleat 600 is likewise substantially identical.

To form a heat exchanger 500, a plurality of plates 502 are stacked together, each adjacent plate 502 being either flipped or rotated 180 degrees with respect to the prior plate 502 in the stack, and end plates 504, 506 are located at either side of the stack, with inlet 508 and outlet 510 aligning with corresponding manifold cutouts 514, 516 in the plates 502. Likewise, individual pleats 600 are placed into each passage 512 in the structure, and the resulting assembly may be brazed together or otherwise secured into a unitary form to form heat exchanger 500. Other forms of attachment, such as adhesives, etc., may also be used.

The heat exchangers 400 and 500 described herein are manufacturable with little waste as compared to that of 100, as fewer machining steps are needed, and a square form need not be rounded by machining.

Although the heat exchangers hereof have been described primarily as right circular cylindrical members having a relatively small aspect ratio, it should be understood that the modular construction taught herein may be employed to manufacture heat exchangers having any cross sectional profile, while maintaining a relatively high ratio of heat exchange surface area within the resulting volume. Likewise, although the heat exchanger has been primarily described as being fabricated of aluminum and brazed together, other materials for the underlying heat exchange element 100 materials may be substituted therefor, so long as the resulting structure meets the specific requirements of the heat exchanger. Further, the resulting structure is readily configurable to a specific need, has relatively interchangeable parts, and may be fabricated in mass.

While the foregoing is directed to embodiments of the present invention, other and further embodiments of the invention may be devised without departing from the basic scope thereof, and the scope thereof is determined by the claims that follow.

The invention claimed is:

1. A heat exchanger having a first side and an opposed second side, comprising:

a plurality of individual heat exchange elements, each of said elements including:

a first flow passage configured to be communicable with a first fluid flow passing through the heat exchanger only in a direction from the first side to the second side thereof; and a second flow passage, fluidly isolated from said first flow passage, configured to be communicable with a second fluid flow passing through the heat exchanger only in a direction transverse to the flow direction of the first fluid flow passage; and an intermediate member, different than an individual heat exchange element, interposed between said first flow passage of one of said heat exchange elements and the second flow passage of another of said heat exchange elements.

2. The heat exchanger of claim 1, wherein at least one of said flow passages includes a plurality of fins therein.

3. The heat exchanger of claim 1 wherein a web extends between said first and said second flow passages of said heat exchange elements.

4. The heat exchanger of claim 1, wherein said intermediate member enables heat exchange therethrough.

5. The heat exchanger of claim 1, wherein said intermediate member and said individual heat exchange elements are brazed together.

6. The heat exchanger of claim 3, wherein said web enables heat exchange between said first flow passage and said second flow passage of said same member.

7. The heat exchanger of claim 1, wherein the plurality of heat exchange elements comprise a plurality of individual plates each having a first flow passage and a second flow passage extending therethrough, and a cap plate provided in parallel with and on either side of the plurality of individual plates, wherein the length of the second flow passages in the individual plates adjacent to the cap plates of the heat exchanger is shorter as compared to the central regions of the heat exchanger.

8. The heat exchanger of claim 7, wherein a gas flows through the plurality of first flow passages provided by the plurality of individual plates and a fluid flows through the plurality of second flow passages provided by the plurality of individual plates.

9. A heat exchanger, comprising:

a plurality of plates stacked one upon the other, each of said plates having a first axis of symmetry and a second axis of symmetry;

a plurality of openings disposed in rows parallel to said first axis of symmetry, the position of said rows being symmetric to either side of said first axis of symmetry, and the position of said openings being symmetric to either side of said second axis of symmetry, and the openings of each plate aligned to form a continuous flow channel extending through each of the aligned openings of each of the plurality of plates stacked one upon the other; and a plurality of rows of slots separated by lands, said rows of slots and lands being disposed intermediate of said rows of openings and generally parallel thereto, said rows being disposed to either side of said first axis of symmetry and symmetrically distanced therefrom, and said lands and slots being disposed asymmetrically with respect to said second axis of symmetry, the lands disposed such that the lands of a plate in the plurality of plates do not overlie the lands of an adjacent plate in the plurality of plates;

wherein said lands and slots of adjacent plates form a tortuous pathway through the heat exchanger, the tortuous pathway extending transverse to the flow path of said aligned openings.

10. The heat exchanger of claim 9, wherein said openings include a plurality of fins, disposed generally parallel to each other with apertures extending therebetween, therein, said apertures providing individual flow passages through the openings through the heat exchanger.

11. The heat exchanger of claim 10, wherein said openings are formed from aligned apertures extending through said individual plates.

12. The heat exchanger of claim 11, further including a first end plate having an inlet and an outlet therethrough, and a second end plate.

13. The heat exchanger of claim 1, wherein the flow passages further comprise a base and one or more side walls, and wherein a plurality of fins extend from the base substantially parallel to the side walls.

14. The heat exchanger of claim 1, wherein an end cap is disposed against an intermediate member at either end of the heat exchanger.

15. The heat exchanger of claim 7, wherein a plurality of shim holes are formed through the cap plates.

16. The heat exchanger of claim 9, wherein the flow passages further comprise a base and one or more side walls, and wherein the plurality of fins extend from the base substantially parallel to the side walls.

17. The heat exchanger of claim 9, wherein the heat exchanger comprises the plurality of plates, wherein the plates are aligned to align the openings through the individual plates to form continuous flow channels through a thickness dimension of the heat exchanger.

18. The heat exchanger of claim 9, further comprising a manifold cutouts with a generally arcuate shape fluidly connecting to the plurality of rows of slots.

19. The heat exchanger of claim 18, wherein the manifold cutouts have a generally arcuate shape.

* * * * *